US005305058A

United States Patent [19]

Sulenski et al.

[11] Patent Number: 5,305,058

[45] Date of Patent: Apr. 19, 1994

[54] PROGRESSIVE LEVELS OF AUTOMATIC MACHINE QUALITY ADJUST

[75] Inventors: Shelly D. Sulenski, Walworth; Fritz Ebner, Rochester, both of N.Y.

[73] Assignee: Xerox Corporation, Stamford, Conn.

[21] Appl. No.: 940,257

[22] Filed: Sep. 2, 1992

[51] Int. Cl.[5] ..... G03G 15/00

[52] U.S. Cl. ..... 355/208; 355/207

[58] Field of Search ..... 355/208, 204, 203, 206, 355/209, 207; 358/298, 456, 406; 371/12, 16.4; 364/521; 340/706

[56] References Cited

U.S. PATENT DOCUMENTS 4,711,556 12/1987 Abuyama .

5,045,880 9/1991 Evanitsky et al. ..... 355/200

*Primary Examiner*—A. T. Grimley

*Assistant Examiner*—Thu Dang

*Attorney, Agent, or Firm*—Ronald F. Chapuran

[57] ABSTRACT

A technique for selectively adjusting the quality of an image processing apparatus in relation to deviations from image quality standards including the steps of recognizing a deviation of the image processing apparatus from the image quality standards, responding to the state of deviation from the image quality standards by providing a plurality of time delays for adjusting the quality of the image processing apparatus, the time delays include automatically adjusting the quality of the image processing during a current job run, automatically adjusting the quality of the image processing apparatus upon completion of a current job run, and automatically adjusting the quality of the image processing apparatus upon a predetermined time delay after completion of a current job.

13 Claims, 4 Drawing Sheets

PROGRESSIVE LEVELS OF AUTOMATIC MACHINE QUALITY ADJUST

BACKGROUND OF THE INVENTION

The invention relates to image quality adjustments and more particularly, to progressive levels of copy quality adjustment in an image reproduction machine.

It is important in the operation of complex electronic equipment such as reproduction machines to maintain the quality of the finished copy sheets. To this end, machines often undergo periodic quality adjustments. It is also important for efficiency to reduce the time spent in monitoring and maintaining the machine operation. Quality adjustments can be initiated automatically in response to recognized conditions or can be manually initiated by service representatives. The need for quality adjustments becomes even more crucial in machines adapted for highlight color or full color reproductions. Such machines often require more extensive or more frequent analysis and correction to produce a quality color product.

It is known in prior art machines for the machine to cycle down in the middle of a reproduction job to initiate a needed copy quality adjustment. Often manual operator intervention is needed both to initiate the quality adjustment and to cycle up or return the machine from the adjustment phase to resume completing the reproduction job. This type of required operator attention is particularly inefficient. In addition, prior art machines often require operator intervention after the completion of a quality adjustment to initiate a new job demand. Also, in prior art machines, the machine may simply cycle down after completion of a job when a quality adjustment is needed and requires operator intervention initiation of the quality adjustment.

In the prior art, it is also known to be able to enter and store copying information in a reproduction machine. For example, U.S. Pat. No. 4,711,556 discloses a copying machine that allows for inputting copying instructions, means for temporary storage of these instructions, an interrupt mode that will let the operator input different copying instructions, a readout of the new instructions, and a means to return to the original mode settings once the interrupt is completed.

In addition, U.S. Pat. No. 5,045,880 assigned to the same assignee as the present invention, discloses a technique for pre-programming a reproduction machine for a plurality of complete jobs involving a variety of machine features and requirements using the operator console and touch sensitive screen display while the machine is still in the process of completing a previous job. In particular, while the machine is in operation, a job can be pre-programmed to simulate a plurality of features and subfeatures of the machine.

While quality adjustments are necessary to maintain machine quality standards, an efficient machine should tolerate only brief and limited machine downtime during the quality modifications. It would be desirable, therefore, to minimize the diagnostic time of service representatives as well as minimize the lack of machine productive output and operator machine attention during quality adjustments. It would also be desirable to be able to automatically initiate a quality adjustment as well as to be able to automatically resume operation, such as completion of the current job or initiation of the next job, after completion of the quality adjustment. It would also be desirable to be able to selectively delay or postpone a quality adjustment depending upon the nature of the quality adjustment needed and the pending jobs to be completed.

It is an object of the present invention, therefore, to provide a new and improved technique to make quality adjustments and corrections in an imaging machine without extensive operator intervention. It is still another object of the present invention to be able to selectively schedule, with appropriate delay, if necessary, copy quality adjustments, dependent upon the nature of the adjustment required and pending job demands, and to be able to complete the quality adjustments and resume operation without operator intervention. Other advantages of the present invention will become apparent as the following description proceeds, and the features characterizing the invention will be pointed out with particularity in the claims annexed to and forming a part of this specification.

SUMMARY OF THE INVENTION

Briefly, the present invention is concerned with a technique for selectively adjusting the quality of an image processing apparatus in relation to deviations from image quality standards including the steps of recognizing a deviation of the image processing apparatus from the image quality standards, responding to the state of deviation from the image quality standards, and providing a plurality of time delays for adjusting the quality of the image processing apparatus. The time delays include immediately adjusting the quality of the image processing during a current job run, automatically adjusting the quality of the image processing apparatus upon completion of a current job run, and automatically adjusting the quality of the image processing apparatus upon a predetermined time delay depending upon job requirements after completion of a current job.

For a better understanding of the present invention, reference may be had to the accompanying drawings wherein the same reference numerals have been applied to like parts and wherein:

DETAILED DESCRIPTION OF THE DRAWINGS

Figure 1:
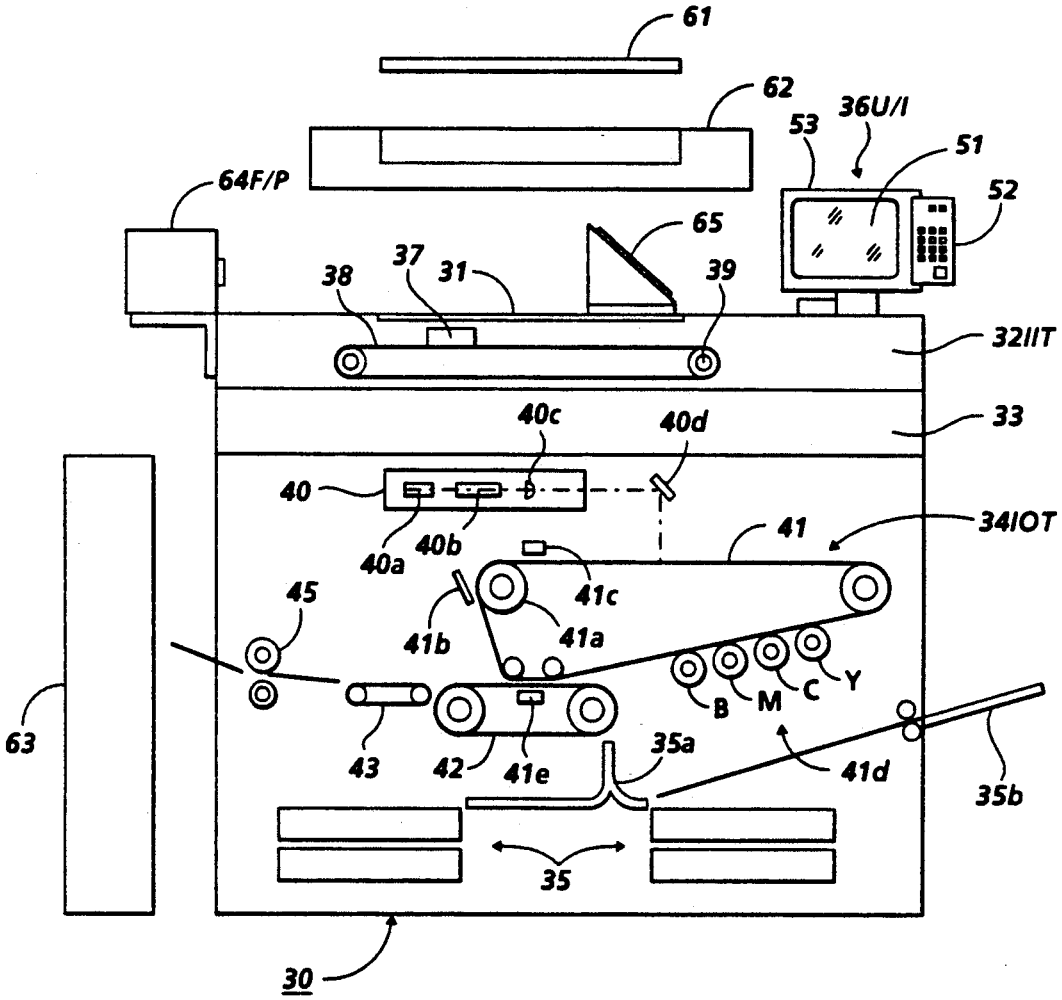
FIG. 1 is a schematic elevational view depicting various operating components and subsystems of a typical machine incorporating the present invention.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention.

DETAILED DESCRIPTION OF THE PREFERRED EMBODIMENT

For a general understanding of the features of the present invention, reference is made to the drawings. In the drawings, like reference numerals have been used throughout to identify identical elements.

FIG. 1 shows one example of the overall construction of a color copying machine to which this Invention is applied. A typical color copying machine to which this invention is applied is formed with the base machine 30, composed of a platen glass plate 31, which carries the original sheet thereon, an image input terminal (IIT) 32, an electrical control system container 33, the image output terminal (IOT) 34, and a paper tray 35, and a user interface (U/I) 36 and also, as optional items, of an editing pad 61, an automatic document feeder (ADF) 62, a sorter 63, and a film projector (F/P) 64.

Electrical hardware is necessary for performing the control of the IIT, IOT, U/I, etc. mentioned above, and a plural number of boards for control of each of the processing units, such as the IIT, IPS, U/I, F/P, and so forth, which perform the image-forming process for the output signals from the IIT, and these are accommodated further in the electrical control system container 33.

The IIT 32 is composed of an imaging unit 37, the wire 38 for driving the said unit, the driving pulley 39, and so forth, and IIT 32 reads a color original sheet for each of the primary colors B (Blue), G (Green), and R (Red) by means of a CCD line sensor and a color filter provided inside the imaging unit 37, converts the data so obtained into digital image signals and then outputs the signals to the IPS.

In the IPS, the B, G, and R signals mentioned above are transformed into the primary colors of the toner, i.e. Y(Yellow), C(Cyan), M(Magenta), and K(Black), and then, with various data processing being applied to the data so obtained for the purpose of enhancing the reproduction fidelity and fineness, and so forth, the IPS converts the toner signals of the process color in harmonious gradation into binary toner signals and outputs them to the IOT 34.

The IOT 34, which is provided with a scanner 40 and a photosensitive material belt 41, converts the image signals from the abovementioned IPS into optical signals in the laster output part 40*a* and forms a latent image corresponding to the image on the original sheet on the photosensitive material belt 41 by way of the polygon mirror 40*b*, the lens 40*c*, and the reflexive mirror 40*d*. The photosensitive material belt 41, which is driven by the driving pulley 41*a*, has a cleaner 41*b*, a charging unit 41*c*, the individual developing devices for Y, M, C, and K, and a transfer device 41*e* arranged around it. And, opposite to this transfer device 41*e* is provided a transfer unit 42, which takes into it the sheet that comes transported to it from the paper tray 35 via the paper transport channel 35*a* and transfers the colors in the order of Y, M, C, and K, the transfer unit 42 being rotated four turns, for example, for full-color copying in four full colors. The sheet of paper on which the image is so transferred is then transported from the transfer unit 42 via the vacuum transport device 43 to the fixing device 45, where it is fixed, and is thereafter discharged from it. Moreover, the paper transport channel 35*a* is so designed as to accept the paper fed alternatively from the SSI (Single Sheet Inserter) 35*b*.

The U/I 36 is designed for use by the user for making the selections of the desired functions and for giving instructions regarding the conditions for the execution of the selected functions, and this system is provided with a color display unit 51 and a hardware control panel 52 installed by the side of the said display unit, and it is further combined with an infrared ray touch board 53, so that instructions can be given directly with the "soft buttons" on the screen. For further details reference is made to U.S. Pat. No. 5,032,903 incorporated herein.

Figure 2:
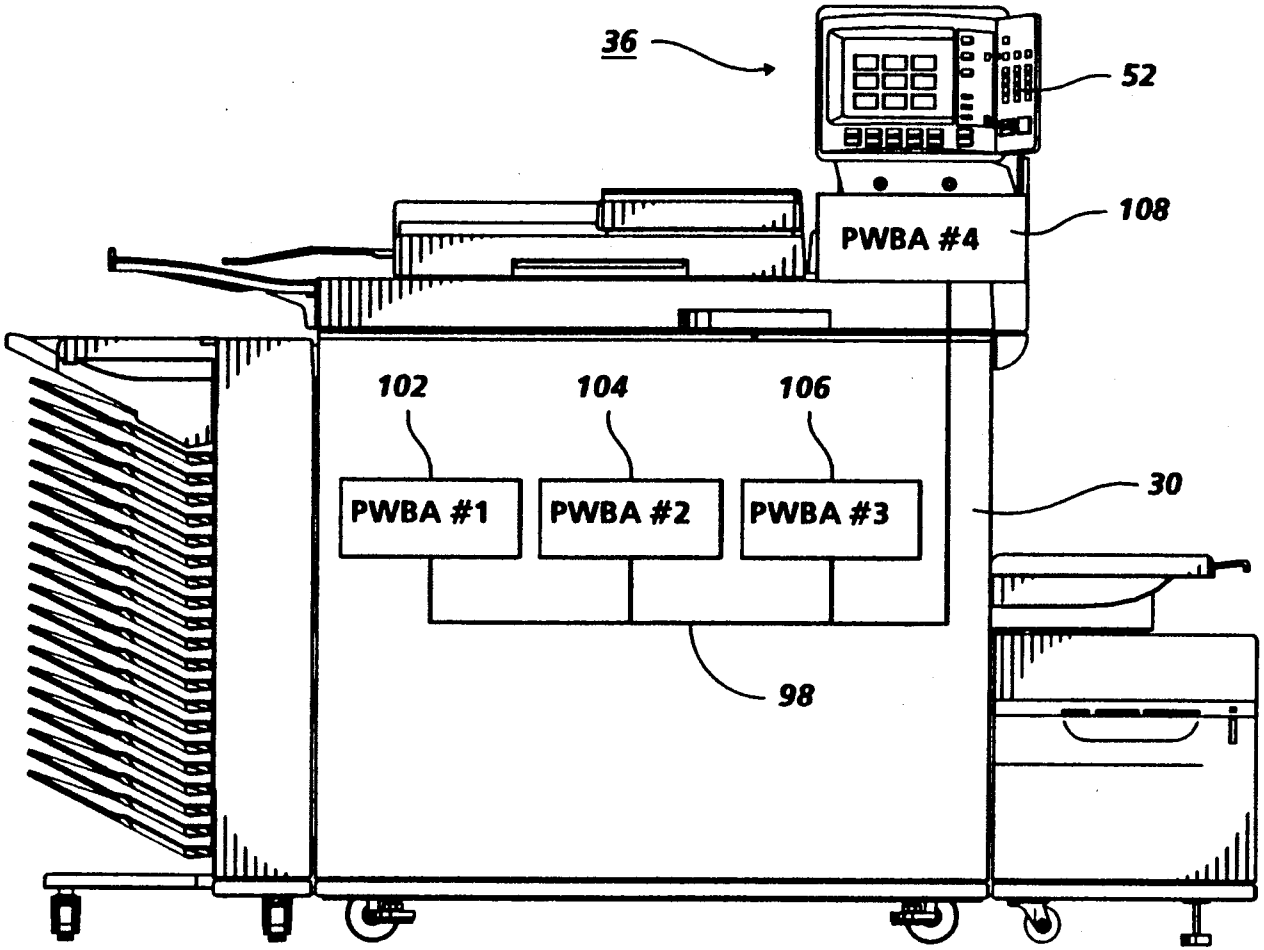
FIG. 2 is a schematic illustrating the control boards for control of the machine shown in FIG. 1.

With reference to FIG. 2, there is illustrated in general block form, the control of the base machine 30 shown in FIG. 1. The base machine is controlled by a plurality of printed wiring boards interconnected to a common channel or bus 98. For purposes of explanation, four printed wiring boards, boards 102, 104, 106 and 108 are illustrated, with printed wiring board 108 being the control for the user interface 36 and the remaining printed wiring boards providing control for predetermined systems and components of the base machine 30. It should be understood that the number of printed wiring boards and the manner of interconnection is merely a design choice and any other suitable control scheme for controlling the base machine is contemplated within the scope of this invention. It should also be noted that one of the printed wiring boards, for example, board 102 could be the master control for the other printed wiring boards or that there could be any number of master slave relationships of the control boards or distributed control of the various functions of the base machine.

Figure 3:
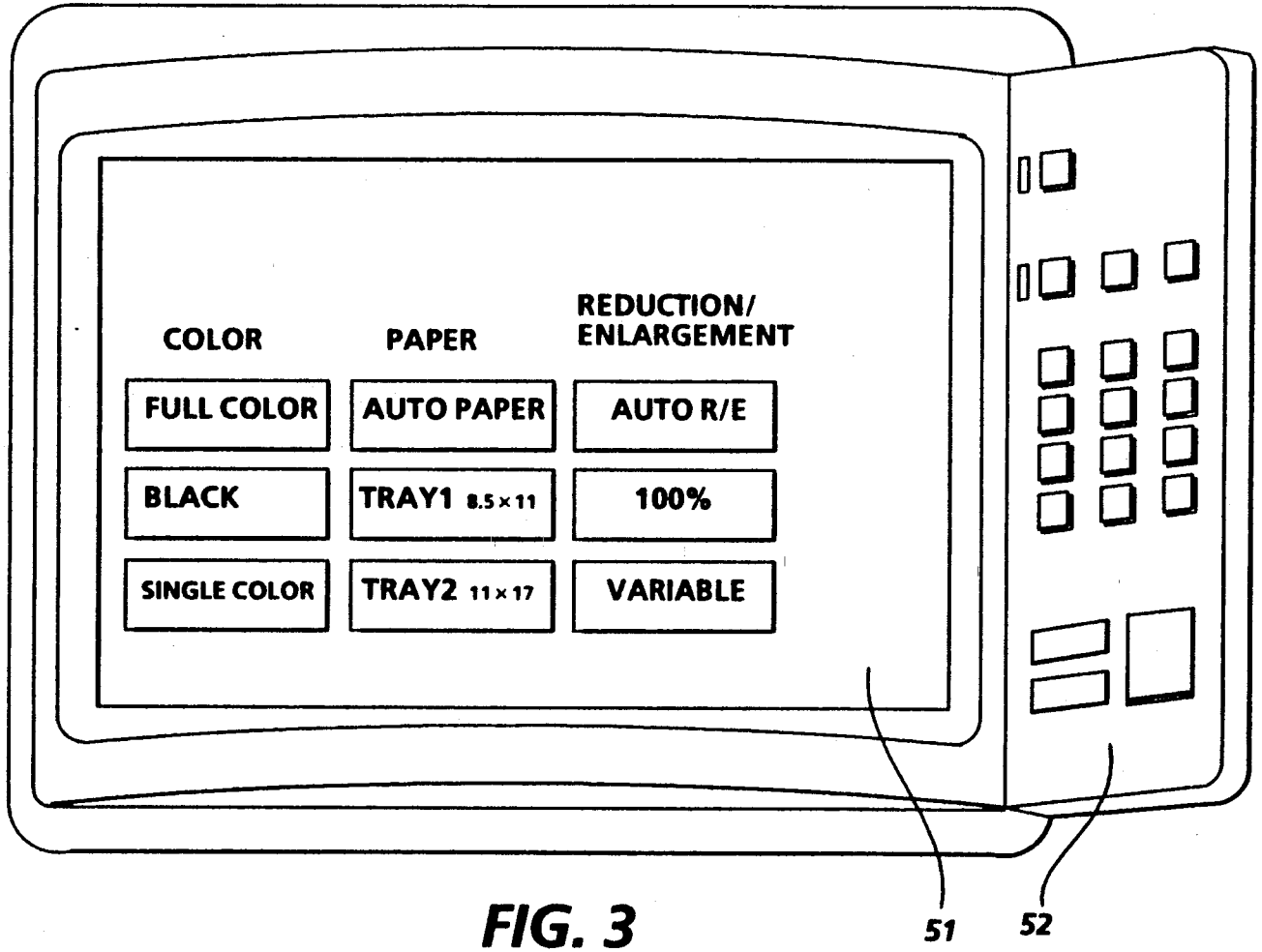
FIG. 3 is an exploded view of the touch monitor screen depicted in FIG. 2.

For purposes of understanding the present invention, it is only necessary to know that the base machine 30 has control software resident on several printed circuit boards that communicate with each other using a common network, and that the base machine 30 has a user interface 36 that is controlled by software that is also part of the common network, illustrated by printed circuit board 108. FIG. 3 is merely a simplified version of the color display unit 51, and hardware control panel 52 of the user interface 36 illustrating various soft control buttons such as full color, auto paper, and auto reduction/enlargement.

The printed circuit board 108 controlling the user interface 36, is able to monitor all communications on the network 98 and display the communications on the screen 51. In the event of a machine malfunction, the service representative enters a hard key sequence that is recognized by the printed circuit board 108. This recognition of the key sequence by the printed circuit board 108 enables the control 108 to monitor the communications network 98 and display the communications appearing on the screen 51. In short, the service representative merely enables a predetermined key sequence at the hardware control panel 52 to initiate a communications network monitor mode to monitor communications between selected elements such as the printed wiring boards 102, 104, 106 and 108 on the network 98.

In accordance with the present invention, there is provided a sequence of automatic copy quality adjustments, independent of operator or service representative intervention. There are generally two levels of copy quality adjustment. The first level is in immediate copy quality adjustment due to the unacceptability of the quality of the produced images. For example, the supply of toner in the developer housing could be at such a low level that the machine is producing or about to produce images or copies too light or faded to be considered standard quality. For example, in a typical development system in a reproduction machine, a toner concentration sensor in a developer housing provides a measure of toner concentration that is compared to a standard or set point. If the level of toner concentration falls below a predetermined level, a signal triggers a copy quality adjustment. The change could be an adjustment to the developer bias. Such an adjustment often must be done immediately because any further images or copies would be unacceptable.

Another general level of copy quality adjustment would be an adjustment that can be delayed until the end of the current job or even possibly until the end of subsequent jobs or to the end of a given time period. In the above example, the toner concentration sensor could provide a signal that is compared to more than one set point. One of the set points could require the immediate copy quality adjustment as described above, but another set point could merely indicate a loss of quality that is not significant to require an immediate correction.

Other situations that would not require an immediate correction would be thresholds that trigger periodic copy quality adjustments. For example, it is not uncommon for machines periodically to do a copy quality adjustment, particularly in quality significant machines such as those with full color or high light color capability. Therefore, although it is desirable to periodically do a copy quality adjustment automatically within the machine after a given period of time, the quality may not have deteriorated to the point where an immediate copy quality correction is needed.

Other examples are controls that would initiate an automatic copy quality adjustment after a given number of images or copies are produced. Such copy quality adjustments could be delayed, particularly if the machine is in the middle of a job run. In fact, it may be desirable for efficiency and operator convenience, particularly in large volume large production operations, to delay such quality adjustments until a more appropriate time, such as between production runs, or during the down time of the machine.

In accordance with the present invention, there is a hierarchy or progressive level of copy quality adjustments. Assume that a copy quality adjustment is scheduled or is necessary. At a first level, a decision is made whether or not the copy quality has diminished or deteriorated to a totally unacceptable level or to the point where an immediate copy quality adjustment is required. The adjustment could automatically reset bias potentials, for example, in the developer system to compensate for the depletion of toner within the housing.

At a second level, assume that an immediate copy quality adjustment is not required but can be delayed. At a second level, a decision is made on how long to delay the adjustment. The system can be adapted to delay the copy quality adjustment based upon predetermined factors. For example, the adjustment could be delayed just until the end of the current job in progress. Or the copy quality adjustment could be delayed indefinitely as long as additional reproduction jobs are queued or initiated within a predetermined time after the completion of the current job up to a maximum time delay. This of course, gives the advantage of a more efficient operation and not interrupting any available jobs until there is a normal hiatus or down time between the beginning of a next job. During this hiatus time it would be more appropriate to initiate the copy quality adjust.

It should be noted that a copy quality adjust even in a relatively complex color machine, may only be approximately two minutes. Yet, a two minute interruption in the middle of a job or even between jobs is often unsatisfactory to an operator and the general operation of a print center. It should be noted that the scope of the instant invention is applicable to immediate copy quality adjustment or delayed adjustment at any stage of machine operation. Specifically, a reproduction machine is often in various states of operation, for example, warm up, stand by, ready, or cycle down. It should be understood that in the scope of the present invention, it is immaterial as to the state of the machine to be able to initiate immediately or automatically delay copy quality adjustment based upon currently sensed conditions or predetermined events or criteria.

It should be noted that the hierarchy or progressive level of quality adjustments as contemplated within the scope of the present invention, can be very flexible. The adjustments can be adapted to a wide variety of specific machines or to a machine environment such as a plurality of different machines on a network. An underlying principle for the application of the instant invention, no matter what the machine environment, is that machine performance is measured against standards of expected quality. Obviously, these standards can vary from machine to machine or can even be altered within a given machine. However, once the standards have been set the principles of the instant invention are to measure machine performance against the standards and take appropriate responses depending upon the degree of deviation from the standards. For example, because of customer demands or requirements some deviations might dictate an immediate copy quality adjustment to bring the machine quality within a range of acceptably quality. If, on the other hand, the machine could not be returned to this range, a machine shutdown would be necessitated, and the services of a technical representative or some immediate action requested by an operator.

In other instances, a deviation from the standards of quality could dictate that the operator be alerted by a suitable message of an impending need, but that the quality is of sufficient standard that the machine need not be shut down at that particular time. Finally, there are a variety of situations of deviations from the set quality standard that dictate a copy quality adjustment, but that the adjustment can be delayed for a given period of time. The given period of time can be a variable that depends upon the nature of the deviation from the quality standard such things as customer requirements, and a backlog of jobs to be completed particularly in an electronic printer. The delay or deferment of the copy quality adjustment can be dependent upon a hiatus in jobs to be run rather than interrupting a job or set of jobs in a printer cue. The time period could also simply be a pre-programmed time period.

Figure 4:
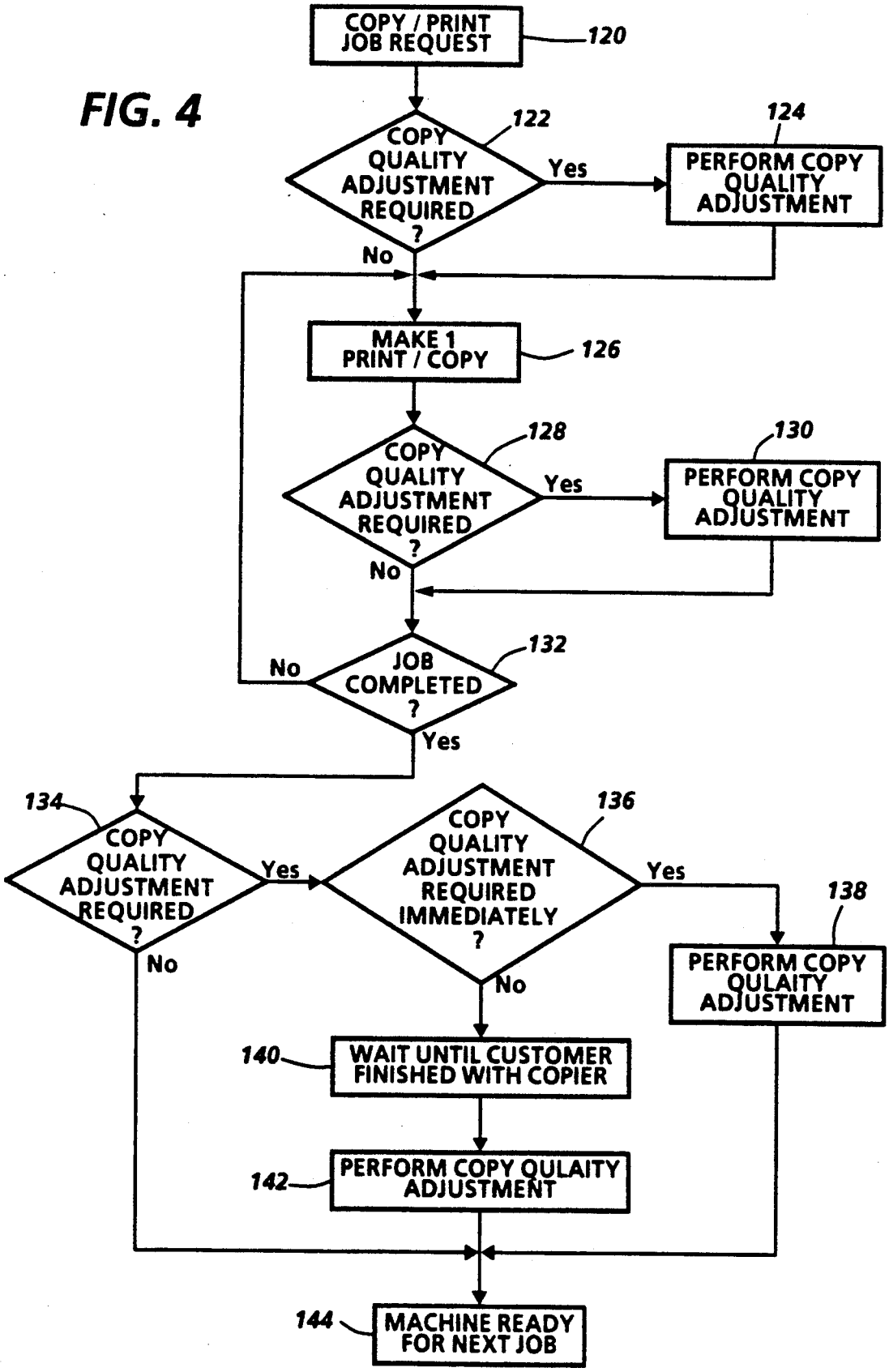
FIG. 4 is a flow chart illustrating the progressive copy quality adjustment technique in accordance with the present invention.

A typical scenario of operation is illustrated in FIG. 4. At block 120 a copy or print job is requested. This could be an appropriate time to determine if a copy quality adjustment is required as illustrated at the decision block 122. If there is an immediate copy quality adjustment required for reasons cited above, then the copy quality adjustment could be immediately performed as illustrated at block 124. If no copy quality adjustment is required, the machine proceeds to make the first print at block 126.

After each copy or print is made, it could be appropriate to recheck copy quality to see if an adjustment is required as illustrated at decision block 128. Within the scope of the present invention, it is a matter of choice how often to analyze the machine for a copy quality adjustment. It could be done after each print after a govern number of prints or after the completion of a job or a given number of jobs. At any rate, at a set or periodic time copy quality is analyzed and a decision is made whether or not an adjustment is necessary. If an immediate adjustment is required, a quality adjustment is made as illustrated at block 130. If not, the machine continues to complete the job as illustrated at decision block 132. If the job is not completed, the system cycles to continue the job at hand. If the job is completed, this could be an appropriate time to consider whether or not a copy quality adjustment is required as illustrated at block 134 in FIG. 4B. If a copy quality adjustment is not needed at this point in time, the machine remains in a ready status in contemplation for a next job requirement as illustrated at block 144.

If a copy quality adjustment is required, then the decision is made as to whether or not it should be done immediately as illustrated at block 136. If immediate, the adjustment is made as illustrated at block 138 and the machine returns to the machine ready steady status as shown at block 144. If the copy quality adjustment is not required immediately, then the copy quality adjustment is deferred. The deferment could be until the completion of the job at hand or a given number of jobs by given customer is completed as illustrated at block 140. It should also be noted, with reference back to a copy adjustment required at blocks 122 and 128, it was assumed an immediate adjustment was required and performed at blocks 124 and 130. However, it would be appropriate for the copy quality adjustments to be deferred at these steps of the job reproduction run as illustrated at decision block 136. Block 140 illustrates a delay until a customer finishes with the copier, but has stated above, the delay could be for any number of reasons and signaled to the machine by such things the lapse of a given period of time, a prior history of machine activity, a print cue or expectation future machine activity or even the determination of such things as the printing of a set number of copies. Block 142 illustrates the copy quality adjustment is made and upon completion of the quality adjustment the machine is ready for the next job as illustrated at 144.

While the invention has been described with reference to the structure disclosed, it is not confined to the details set forth, but it is intended to cover such modifications or changes as may come within the scope of the following claims.

We claim:

1. In an image processing apparatus having image processing components for forming images on a medium, a controller for directing the operation of the image processing components including an image quality monitoring element for checking the operation of the machine in relation to image quality standards, the method of automatically adjusting the quality of the image processing apparatus, the image processing apparatus having a hierarchy of quality adjustments, comprising the steps of:

initially determining whether or not the quality has deteriorated to a first level of deviation from the image quality standards, in response to initially determining the first level of deviation from image quality standards making an immediate copy quality adjustment to the image processing apparatus determining the quality has deteriorated to a second level of deviation from the image quality standards, and responding to a determination of a second level of deviation from the image quality standards to schedule a delay of a copy quality adjustment to the image processing apparatus, the delay being a variable of said second level of deviation, the delay being dependent upon the number of required jobs.

2. The method of claim 1 wherein the delay is a given time period after machine operation or a function of a given number of images.

3. In an image processing apparatus having image processing components including a photosensitive element supporting a latent image, a developer to develop the latent image, a source of copy sheets, and a transfer station to transfer images from the photosensitive element to the copy sheets, the image processing apparatus being provided with a set of job requirements, a controller for directing the operation of the image processing components including an image quality monitoring element for checking the operation of the machine in relation to image quality standards, the method of automatically adjusting the quality of the image processing apparatus depending upon the deviation of the image processing apparatus from the image quality standards, comprising the steps of:

recognizing a deviation from the image quality standards, determining a time period of response to said deviation from the image quality standards, and providing a quality adjustment to the image processing apparatus in response to said deviation from the image quality standards, said quality adjustment being related to said time period of response and to said set of job requirements.

4. The method of claim 3 wherein the image quality standard is the lapse of a given time period.

5. In an image processing apparatus having image processing components for forming images on a medium to complete current and anticipated job requirements, a controller for directing the operation of the image processing components including an image quality monitoring element for checking the operation of the machine in relation to image quality standards, deviations from the image quality standards being level 1 or level 2, the method of selectively adjusting the quality of the image processing apparatus in relation to the image quality standards during a current job run, comprising the steps of:

recognizing a deviation of the image processing apparatus from the image quality standards, responding to a level 1 deviation by interrupting the current job run, adjusting the quality of the image processing apparatus, and automatically resuming the job run, responding to a level 2 deviation by providing a delay time for adjusting the quality of the image processing apparatus, the delay time being a function of the current job and anticipated job requirements.

6. In an image processing apparatus having image processing components for forming images on a medium to complete job requirements, a controller for directing the operation of the image processing components including an image quality monitoring element for checking the operation of the machine in relation to image quality standards, deviations from the image quality standards being level 1, level 2 or level 3 deviations, the method of selectively adjusting the quality of the image processing apparatus in relation to the deviations from the image quality standards comprising the steps of:

recognizing a deviation of the image processing apparatus from the image quality standards, responding to a level 1 deviation by providing a first delay time for adjusting the quality of the image processing apparatus, responding to a level 2 deviation by providing a second delay time for adjusting the quality of the image processing apparatus, and responding to a level 3 deviation by providing a third delay time for adjusting the quality of the image processing apparatus.

7. The method of claim 6 wherein responding to a level 1 deviation includes the steps of automatically interrupting a current job run, adjusting the quality of the image processing, and resuming the current job run.

8. The method of claim 6 wherein responding to level 2 deviation includes the step of automatically adjusting the quality of the image processing apparatus upon completion of a current job.

9. The method of claim 6 wherein responding to level 3 deviation includes the step of automatically adjusting the quality of the image processing apparatus upon a predetermined time delay after completion of a current job.

10. In an image processing apparatus having image processing component for forming images on a medium to complete job requirements, a controller for directing the operation of the image processing components including an image quality monitoring element for checking the operation of the machine in relation to image quality standards, deviations from the image quality standards being level 1, level 2 or level 3 deviations, the method of selectively adjusting the quality of the image processing apparatus in relation to the deviations from the image quality standards comprising the steps of:

recognizing a deviation of the image processing apparatus from the image quality standards including the, responding to a level 1 deviation by providing a first delay time for adjusting the quality of the image processing apparatus including the steps of automatically interrupting a current job run, adjusting the quality of the image processing, and resuming the current job responding to a level 2 deviation by providing a second delay time for adjusting the quality of the image processing apparatus, including the step of automatically adjusting the quality of the image processing apparatus upon completion of a current job and responding to a level 3 deviation by providing a third delay time for adjusting the quality of the image processing apparatus including the step of automatically adjusting the quality of the image processing apparatus upon a predetermined time delay after completion of a current job.

11. In an image processing apparatus having image processing components for forming images on a medium to complete job requirements, a controller for directing the operation of the image processing components including an image quality monitoring element for checking the operation of the machine in relation to image quality standards, the deviations from the image quality standards having a plurality of states, the method of selectively adjusting the quality of the image processing apparatus in relation to the deviations from the image quality standards comprising the steps of:

recognizing a deviation of the image processing apparatus from the image quality standards including the, responding to the state of deviation from the image quality standards by providing a plurality of time delays for adjusting the quality of the image processing apparatus, the time delays include automatically adjusting the quality of the image processing during a current job run, automatically adjusting the quality of the image processing apparatus upon completion of a current job run, and automatically adjusting the quality of the image processing apparatus upon a predetermined time delay after completion of a current job.

12. An image processing apparatus having image processing components for forming images on a medium including a photosensitive element, a developer, and a transfer station to transfer images from the photosensitive element to the medium, a controller for directing the operation of the image processing components, a device for monitoring the operation of the image processing apparatus relative to image quality standards, and means for initiating a quality adjustment of the image processing apparatus in response to said standards including means for automatically adjusting the quality of the image processing during a current job run, means for automatically adjusting the quality of the image processing apparatus upon completion of a current job run, and means for automatically adjusting the quality of the image processing apparatus upon a predetermined time delay after completion of a current job run.

13. An image processing apparatus having image processing components for forming images on a medium, a controller for directing the operation of the image processing components including a source of copy sheets, a photosensitive element and a transfer station to transfer images from the photosensitive element to the copy sheets, a monitor to periodically check the status of the image processing apparatus relative to image quality standards, and a device for initiating a quality adjustment of the image processing apparatus, said device including means for selectively delaying the quality adjustment of the image processing apparatus dependent upon the status of the image processing apparatus relative to image quality standards, the means for selectively delaying including the means to delay a predetermined time period and the means to wait upon the completion of a given event.

* * * * *